United States Patent [19]

Clark, III

[11] Patent Number: 4,537,036

[45] Date of Patent: Aug. 27, 1985

[54] THERMALLY POWERED HEATING SYSTEM

[76] Inventor: Robert W. Clark, III, 2232 W. Joan de Arc Ave., Phoenix, Ariz. 85029

[21] Appl. No.: 654,725

[22] Filed: Sep. 27, 1984

[51] Int. Cl.[3] ..... F25B 1/00

[52] U.S. Cl. ..... 62/116; 62/467

[58] Field of Search ..... 62/116, 467, 333, 335

[56] References Cited

U.S. PATENT DOCUMENTS

| | | | |
|---|---|---|---|
| 3,699,779 | 10/1972 | Schlichtig | 62/467 |
| 3,763,663 | 10/1973 | Schlichtig | 62/467 |
| 4,120,172 | 10/1978 | Pierce | 62/467 |
| 4,418,547 | 12/1983 | Clark, Jr. | 62/467 |
| 4,450,690 | 5/1984 | Clark, Jr. | 62/467 |

*Primary Examiner*—Ronald C. Capossela

*Attorney, Agent, or Firm*—Edward W. Hughes

[57] ABSTRACT

A thermally powered heat transfer system consisting of two closed heat transfer loops which share a compressor which is powered alternately by the refrigerants of the two loops. This system is powered by a single heat source with a portion of the heat from that heat source being transferred at a higher temperature to a structure to be heated, the balance being transferred to a low temperature external heat sink. The first loop includes an evaporator and the condenser within the structure to be heated, and is charged with a first refrigerant. The second loop includes an evaporator and a condenser located so as to transfer heat to an external heat sink. The second loop is charged with a refrigerant having a lower boiling point than the refrigerant in the first loop. Controls are activated at the completion of each compresor stroke or cycle to alternately open and close valves which regulate vapor and liquid flows to cause the compressor to act with compressive force upon one or the other refrigerant vapors during each cycle of operation of the system to effect useful heat transfer.

20 Claims, 1 Drawing Figure

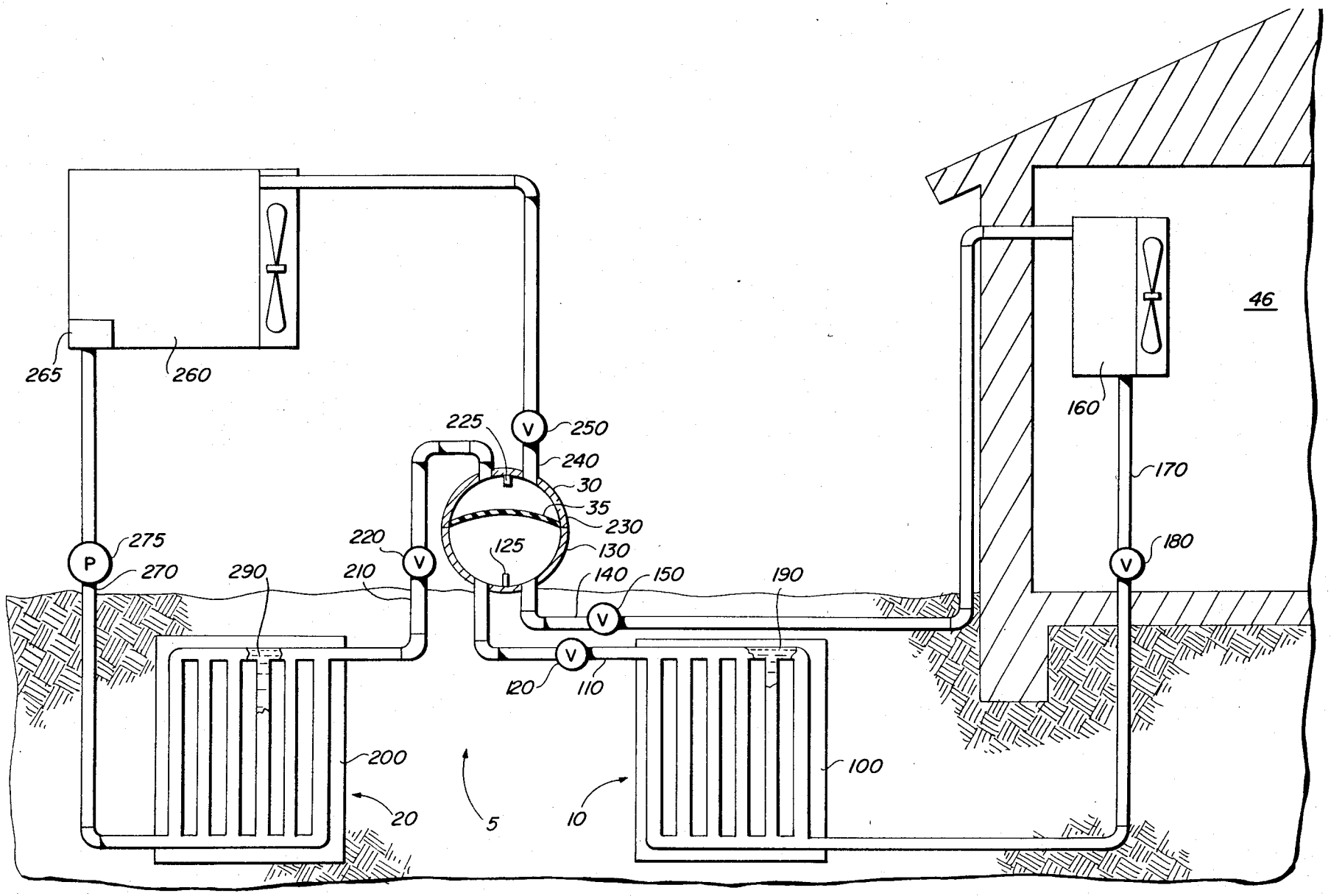
46
160
170
180
100
190
150
140
130
230
35
30
240
250
110
120
10
125
225
5
220
210
200
20
290
260
275
270
265

THERMALLY POWERED HEATING SYSTEM

BACKGROUND OF THE INVENTION

1. Field of the Invention

This invention is in the field of thermally powered heat transfer systems, and more particularly relates to heating systems. This invention incorporates a new general method of converting a portion of the heat from a heat source having a temperature below the temperature desired for a given purpose to the temperature desired for that purpose. This invention actively utilizes some of the heat from that heat source when a sufficiently low temperature heat sink is available to raise the temperature of other heat from that same heat source to a usable temperature. This new general method is of major significance at this time because it permits naturally occurring low grade heat sources, such as ground heat, to be made useful for the heating of homes and other structures.

2. Description of the Prior Art

This invention is related to U.S. Pat. No. 4,418,547 issued Dec. 6, 1983, and is an improvement thereon. The invention described in U.S. Pat. No. 4,418,547 employs two heat sources having different temperatures and one or more heat sinks having an intermediate temperature to effect the cooling or heating of a structure. The present invention employs a single heat source in the presence of a lower temperature heat sink to effect the heating of a structure which itself becomes the higher temperature heat sink. The invention described in U.S. Pat. No. 4,418,547 always has a high temperature heat source above the temperature of the heat sink together with a low temperature heat source below the temperature of the heat sink. The present invention always has a heat sink above the temperature of the heat source together with a second heat sink below the temperature of the heat source. Because this invention has the capability of raising the temperature of a portion of the heat from a lowgrade but quantitatively substantial heat source, it is uniquely useful for the heating of a structure without the use of fuel.

SUMMARY OF THE INVENTION

The present invention provides a thermally-powered heat transfer system particularly adapted to the heating of a home or other structure. The system has two evaporators located so as to acquire heat from the earth or some other low-grade heat source, a first condenser located within the structure to be heated which will have a condensing temperature above the temperature of the heat source, a second condenser located so as to dissipate heat to a low temperature external heat sink, said second condenser always having a condensing temperature below that of the heat source, and a two-chamber compressor with a flexible dividing member, or diaphragm, capable of acting with positive compressive force in both of two possible compressive action directions. These evaporators, condensers, and compressor are joined with the necessary piping and electrically activated valves to form two closed-loop heat transfer systems. One closed loop includes one of the evaporators located so as to acquire heat from the earth or another low-grade source, the high-temperature condenser 1ocated within the structure to be heated, and the first chamber, or cylinder, of the compressor. This first closed loop is filled with a first refrigerant. The second closed loop includes the other of the two evaporators located so as to require heat from the earth, or another low-grade heat source, the second condenser located so as to dissipate heat to a low-temperature external heat sink, and the second chamber or cylinder of the compressor. This second closed loop is filled with a second refrigerant having a lower boiling point at atmospheric pressure than the first refrigerant contained in the first closed loop. The compressor is constructed so that the two refrigerants are kept separate. The refrigerants are selected on ths basis of their thermodynamic properties in relation to each other and system design parameters so that the vapor pressure in the first evaporator will be higher than the vapor pressure of the second refrigerant in the second condenser, thus permitting the first refrigerant to displace the second refrigerant in the compressor, and likewise so that vapor formed in the second evaporator will have a higher pressure than the vapor pressure of the first refrigerant in the first condenser, thus permitting the second refrigerant to displace the first refrigerant in the compressor in turn. Vapor flows are controlled by switches activated by the diaphragm of the compressor at the completion of each portion of the cycle. In this manner the temperature of a portion of the heat from a low-grade heat source can be increased to effect the heating of a home or other structure without the use of a fuel.

It is therefore an object of this invention to provide a thermally-powered heat transfer system which can be used for the heating of a home or other structure.

It is still another object of this invention to provide a new general method for the design of thermally-powered heat transfer systems in which the temperature of a portion of the heat from a low-grade heat source can be increased to provide heat at a useful temperature.

It is still another object of this invention to provide a thermally-powered heating system which can be operated at low purchased-energy cost.

BRIEF DESCRIPTION OF THE DRAWINGS

Other objects, features, and advantages of the invention will be readily apparent from the following description of the preferred embodiment hereof, taken in conjunction with the accompanying drawing, although variation and modifications may be effected without departing from the spirit and scope of the novel concepts of the disclosure, and in which:

The sole FIGURE is a schematic view of a preferred embodiment of the thermally-powered heating system embodying this invention.

DESCRIPTION OF THE PREFERRED EMBODIMENT

The thermally powered heating system 5 depicted in the FIGURE consists of two closed heat transfer loops 10,20 each of which contains a refrigerant in both liquid and vapor states. Closed heat transfer loop 10 includes evaporator 100 located so as to require heat from the earth or from some other low-grade heat source, said evaporator 100 being depicted in the FIGURE as a grid of pipes buried in the earth. Alternative evaporator designs may be selected without departing from the spirit of the invention as defined by the scope of the claims. The top of evaporator 100 is connected by means of refrigerant vapor pipe 110 to the bottom chamber 130 of compressor 30. Vapor flow through refrigerant vapor pipe 110 is regulated by electrically-activated valve 120. The bottom chamber 130 of compressor 30 is connected by means of refrigerant vapor pipe 140 to the top of high-temperature condenser 160 which is located with the air duct of the home, or structure, 46 to be heated, through which air is circulated. Vapor flow through refrigerant vapor pipe 140 is regulated by electrically-activated valve 150. The bottom of high-temperature condenser 160 is connected to the bottom of evaporator 100 by means of refrigerant liquid pipe 170, flow through this pipe being regulated by electrically-activated valve 180. Closed heat transfer loop 10 is filled with refrigerant 190, evaporator 100 and a portion of refrigerant liquid pipe 170 being filled with refrigerant 190 in its liquid state, the rest of closed heat transfer loop 10 being filled with refrigerant 190 vapor.

Closed heat transfer loop 20 includes evaporator 200 located so as to require heat from the earth or from some other low-grade heat source, said evaporator 200 being depicted in the FIGURE as a grid of pipes buried in the earth. The top of evaporator 200 is connected by means of refrigerant vapor pipe 210 to the top chamber 230 of compressor 30. Vapor flow through refrigerant vapor pipe 210 is regulated by electrically-activated valve 220. The top chamber 230 of compressor 30 is connected by means of refrigerant vapor pipe 240 to the top of low-temperature condenser 260 which is located so as to dissipate heat to a low-temperature heat sink, low-temperature condenser 260 being depicted in the FIGURE as being cooled by fan-driven external ambient air. Alternative condenser designs may be selected without departing from the spirit of the invention as defined by the scope of the claims. Vapor flow through refrigerant vapor pipe 240 is regulated by electrically-activated valve 250. The bottom of low-temperature condenser 260 is connected to the bottom of evaporator 200 by means of refrigerant liquid pipe 270, flow through refrigerant liquid pipe 270 being regulated by electrically activated pump 275. Low-temperature condenser 260 is equipped with a liquid level control 265 which activates pump 275 when the level of refrigerant liquid in low-temperature condenser 260 exceeds a given level and deactivates pump 275 when the level of refrigerant in low-temperature condenser 260 drops below a given level. Closed heat transfer loop 20 is filled with refrigerant 90, evaporator 200 and liquid refrigerant pipe 270 being filled with liquid refrigerant 290, the rest of closed heat transfer loop 20 being filled with refrigerant 290 vapor.

Compressor 30 consists of two rigid hemispheres 130 and 230 joined together with a flexible shaped diaphragm 35 between them. Diaphragm 35 is constructed of suitable flexible and impermeable material shaped so as to fit against the inner wall of hemisphere 130 or hemisphere 230. Diaphragm 35 moves from one position to the other in response to the vapor pressures exerted upon it, such movement changing the volume of the upper and lower chambers. When diaphragm 35 is forced by vapor pressure against the inner wall of hemisphere 230, it activates switch 225 which causes electrically-activated valves 120 and 250 to close and electrically-activated valves 150,180, and 220 to open. When diaphragm 35 is forced by vapor pressure against the inner wall of hemisphere 130, it activates switch 125 which causes electrically-activated valves 120 and 250 to open and electrically-activated valves 150,180 and 220 to close.

To illustrate the operation of this invention, let us now assume that the refrigerant 190 with which the first closed heat transfer loop 10 is charged is refrigerant R 12 dichlorodifluoromethane, which has a boiling point at atmospheric pressure of −21.6° F.; that the refrigerant 290 with which the second closed heat transfer loop 20 is charged is refrigerant R 22, chlorodifluoromethane, which has a boiling point at atmospheric pressure of −41.4° F.; that the temperature of the heat source is such that it heats these refrigerants in evaporators 100 and 200 to 55° F.; and that the external air temperature which serves as the heat sink for low-temperature condenser 260 is below 27° F. Let us also assume that, initially, electrically-activated valves 120 and 250 are open and electrically-activated valves 150, 180 and 220 are closed, as depicted in the FIGURE.

At a temperature of 55° F. liquid refrigerant 190 (R12) in evaporator 100 exerts a pressure of 66.74 PSIA. At a temperature of 27° F. any pressure above 65.86 PSIA causes refrigerant 290 (R22) to condense in condenser 260 and lesser pressure is required at temperatures below 27° F. Because of these pressure differences, refrigerant 190 (R12) boils in evaporator 100 and its vapor flows from evaporator 100 through refrigerant vapor pipe 110 and open valve 120 into the lower chamber 130 of compressor 30, causing diaphragm 35 to move upwardly and forces refrigerant 290 (R22) vapor out of the upper chamber 230 of compressor 30, through refrigerant vapor pipe 240 and open valve 250, into condenser 260, where the refrigerant 290 vapor condenses, transferring heat to the external ambient air, a low temperature heat sink. When diaphragm 35 presses against the inner surface of inner hemisphere 230 it activates switch 225 which in turn causes electrically-activated valves 150, 180, and 220 to open. During this first cycle of operation, if the liquid level of refrigerant 290 in condenser 260 exceeds a given level, liquid level control switch 265 activates pump 275 which pumps liquid refrigerant 290 (R22) from condenser 260 through liquid refrigerant pipe 270 into the bottom of evaporator 200. Switch 265 deactivates pump 275 when the level of the liquid refrigerant 290 falls below a given level in condenser 260.

At a temperature of 55° F. liquid refrigerant 290 (R22) in evaporator 200 exerts a pressure of 107.25 PSIA. At a temperature of 85° F. any pressure above 106.47 PSIA causes refrigerant 190 (R12) to condense in condenser 160 and lesser pressure is required at temperatures below 85° F. Because of these pressure differences when switch 225 causes valves 120 and 250 to close and valves 150, 180 and 220 to open, refrigerant 290 (R22) boils in evaporator 200 and its vapor flows from evaporator 200 through refrigerant vapor pipe 210 and open valve 220 into the upper chamber 230 of compressor 30, causing diaphragm 35 to move and force refrigerant 190 (R12) vapor out of the lower chamber of compressor 30, through refrigerant vapor pipe 140 and open valve 150, into condenser 160, where refrigerant 190 vapor condenses at any temperature below 85° F., transferring heat to the structure 46 being heated. As refrigerant 190 (R42) vapor condenses, the liquid refrigerant 190 is forced by gravity through liquid refrigerant pipe 170 and open valve 180 into the bottom of evaporator 100. When the lower chamber of compressor 30 is emptied of refrigerant 190 vapor, diaphragm 35 presses against the inner surface of rigid hemisphere 130 and activates switch 125, which in turn causes electrically-activated valves 120 and 250 to open and electrically-activated valves 150, 180, and 220 to close. This concludes the second cycle of operation and causes the first cycle of operation to repeat.

Given a temperature of 55° F. in evaporator 100 and 200 and an external heat sink temperature below 27° F., this invention will continue to operate until the temperature of the air within the structure 46 to be heated approximates 85° F. The two heat sink temperatures will vary as the heat source temperature varies. Cycle speed increases as the temperatures of the sinks fall below the maximum temperatures. Various refrigerant pairs, other than the pair R12 and R22 used for the example, may be selected to match desired system performance to available heat source and external heat sink temperatures. Such alternate refrigerant pairs may be selected without departing from the spirit of the invention as defined by the scope of the claims.

From the foregoing it should be evident that various modifications can be made to the described invention without departing from the scope of the present invention.

What is claimed is:

1. A thermally powered heat transfer system having a first and a second cycle of operation, comprising:

first and second closed loop heat transfer means each of said transfer means including respectively a first and a second refrigerant, a first and a second condenser means for transferring heat from the first and second refrigerants to a first and a second heat sink, said heat sinks being separate from each other, a first and a second heat exchanger for transferring heat from a common heat source to the first and the second refrigerants, the temperatures ofthe first heat sink being above that of the common heat source and the temperature of the second heat sink being below that of the common heat source;

compressor means for said first and second heat transfer means powered by energy derived from the common heat source for causing said second condenser means to transfer heat from the second refrigerant to the second heat sink during each first cycle of operation and powered by energy derived from the common heat source for causing said first condenser means to transfer heat from the first refrigerant to the first heat sink during each second cycle of operations; and control means for causing such system to change its cycle of operation.

2. A thermally powered heat transfer system as defined in claim 1 which the first and second refrigerants are fluorinated hydrocarbons with the boiling point at atmospheric pressure of the second refrigerant being below that of the first.

3. A thermally powered heat transfer system as defined in claim 1 in which the first refrigerant is dichlorodifluoromethane (R12) and the second refrigerant is chlorodifluoromethane (R22).

4. The thermally powered heat transfer system of claim 3 in which the first heat sink is substantially within a structure to be heated.

5. A thermally powered heat transfer system having two cycles of operation comprising:

a first closed loop heat transfer means having a first evaporator, a first heat sink, a first refrigerant, and first condenser means for transferring heat from a common heat source to the first refrigerant during each first cycle of operation and said first condenser means transferring heat from the first refrigerant to the first heat sink during each second cycle of operation;

a second closed-loop heat transfer means having a second evaporator, a second heat sink, a second refrigerant, and a second condenser means for transferring heat from the second refrigerant to a second heat sink, said second evaporator transferring heat from the common heat source to the second refrigerant during each second cycle of operation and the second condenser means transferring heat from the second refrigerant to the second heat sink during each first cycle of operation;

compressor means powered by the first refrigerant of the first closed loop heat transfer means for compressing the second refrigerant during each first cycle of operation and powered by the second refrigerant of the second closed loop heat transfer means for compressing the first refrigerant during each second cycle;

the temperature of the first heat sink being higher than that of the second;

the temperature of the common heat source being between the temperatures of the first and second heat sinks; the boiling point at standard atmospheric pressure of the second refrigerant being higher than that of the first refrigerant, and control means including valve means for causing the system to switch from one cycle of operation to the other at the completion of each cycle of operation.

6. A thermally powered heat transfer system as defined in claim 5 in which the first refrigerant is dichlorodifluoromethane (R12) and the second is chlorodifluoromethane (R22).

7. A thermally powered heat transfer system as defined in claim 6 in which the valve means are electrically activated.

8. A thermally powered heat transfer system as defined in claim 7 in which the first and second evaporators are buried in the earth and the common heat source is the earth in which the evaporators are buried.

9. A thermally powered heat transfer system as defined in claim 8 in which the first heat sink is substantially located within a structure to be heated.

10. The method of transferring heat from a common heat source to a first and a second heat sink using a first and second refrigerant during two cycles of operation, comprising the steps of:

A. during the first cycle of operation:

1. evaporating the first refrigerant in a first evaporator using heat from the common source;
2. compressing the vaporized second refrigerant using the evaporated first refrigerant as the source of energy;
3. transferring heat from the compressed vaporized second refrigerant in a second condenser to a second heat sink to liquify the second refrigerant;
4. causing the liquified second refrigerant in the second condenser to flow into a second evaporator;
5. initiating a second cycle of operation when substantially all the vaporized second refrigerant available to the second condenser has been liquified;

B. during the second cycle of operation:

1. evaporating the second refrigerant in a second evaporator using heat from the common source;
2. compressing the first refrigerant using the evaporated second refrigerant as the source of energy;
3. transferring heat from the compressed vaporized first refrigerant in a first condenser to a first heat sink to liquify the first refrigerant;

4. causing the liquified first refrigerant to flow from the first condenser into the first evaporator; and
5. initiating the first cycle of operation when substantially all the vaporized first refrigerant available to the first condenser has been liquified.

11. The method of transferring heat of claim 10 in which the temperature of the first heat sink is higher than that of the common heat source and the temperature of the second heat sink is below that of the common heat source.

12. The method of transferring heat of claim 11 in which the first and second refrigerants are fluorinated hydrocarbons with the boiling point at atmospheric pressure of the second refrigerant being below that of the first.

13. The method of transferring heat of claim 12 in which the first refrigerant is dichlorodifluoromethane (R12) and the second refrigerant is chlorodifluoromethane (R22).

14. The method of transferring heat of claim 13 in which the liquified second refrigerant in the second condenser is pumped into the second evaporator when the liqufied second refrigerant in the second condenser exceeds a predetermined amount.

15. The method of removing heat from a common heat source comprising during a first cycle of operation the steps of:

evaporating a first refrigerant in a first evaporator using heat from said common heat source;

compressing a second refrigerant in a compressor powered by the first refrigerant;

condensing the second refrigerant in a second condenser by transferring heat from the second refrigerant to a second heat sink;

initiating a second cycle of operation when substantially all the vaporized second refrigerant has been condensed, the second cycle of operation comprising the steps of:

evaporating condensed second refrigerant in a second evaporator using heat from the common heat source;

compressing the first refrigerant in a compressor powered by the second refrigerant;

condensing the first refrigerant in a first condenser by transferring heat from the first refrigerant to a first heat sink; and initiating the first cycle when substantially all the vaporized first refrigerant has been condensed;

The temperature of the first heat sink being higher than that of the second, the boiling point at standard atmospheric pressure of the first refrigerant being higher than that of the second, and the temperature of common heat source being between the temperatures of the heat sinks.

16. The method of claim 15 in which first and second refrigerants are fluorinated hydrocarbons.

17. The method of claim 16 in which the first refrigerant is dichlorodifluoromethane (R12) and the second refrigerant is chlorodifluoromethane (R22).

18. The method of claim 17 in which the first heat sink is substantially located within a structure to be heated.

19. The method of claim 18 in which the common heat source is the earth.

20. The method of claim 19 in which the second heat sink is the ambient atmosphere.

* * * * *